US011952929B1

(12) United States Patent
Nemeth et al.

(10) Patent No.: US 11,952,929 B1
(45) Date of Patent: Apr. 9, 2024

(54) HYDRACARBON DOZER VALVE PIVOTING MULTI PURPOSE BRACKET

(71) Applicant: FCA US LLC, Auburn Hills, MI (US)

(72) Inventors: Michael L Nemeth, Holly, MI (US); Kevin A Spangler, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/351,718

(22) Filed: Jul. 13, 2023

(51) Int. Cl.
*F01N 13/18* (2010.01)

(52) U.S. Cl.
CPC ..... *F01N 13/1805* (2013.01); *F01N 2260/20* (2013.01)

(58) Field of Classification Search
CPC ..... F01N 13/1805; F01N 2260/20; F01N 2610/1453
See application file for complete search history.

(56) References Cited

U.S. PATENT DOCUMENTS 3,793,838 A * 2/1974 Nash ..... F23R 3/20 60/764
3,811,462 A * 5/1974 Feliz ..... B60R 15/00 137/355.16
4,655,035 A * 4/1987 Sager, Jr. ..... F01N 3/30 285/332.1
6,584,768 B1 * 7/2003 Hecker ..... F01N 3/035 55/318
6,996,976 B2 * 2/2006 Rumminger ..... F16L 41/12 60/272
7,926,604 B2 * 4/2011 Ammer ..... F01N 13/1805 180/309
7,980,063 B2 * 7/2011 Cooke ..... B01D 53/90 60/303
8,024,922 B2 * 9/2011 van Vuuren ..... F01N 3/2066 60/303
8,127,538 B2 * 3/2012 Pollitt ..... F01N 3/36 239/132.3
8,429,903 B2 * 4/2013 Charles ..... F01N 13/1855 60/303
8,495,986 B2 * 7/2013 Reba ..... B23P 6/00 123/470
9,067,551 B2 * 6/2015 Song ..... E05B 81/02
9,103,254 B2 * 8/2015 Merchant ..... F01N 3/035
9,151,201 B2 * 10/2015 Hornby ..... F01N 13/0093
9,188,279 B2 * 11/2015 Sakai ..... F16M 13/02
9,366,174 B2 * 6/2016 Hottebart ..... F01N 13/1805
9,416,709 B2 * 8/2016 Sayer ..... F01N 3/2066
9,546,584 B2 1/2017 Qi
10,190,557 B2 * 1/2019 Roseborsky ..... F02M 63/0225
10,994,603 B2 * 5/2021 Nomura ..... F01N 13/082
11,555,437 B2 * 1/2023 Hogan ..... F01N 13/1844
2005/0056008 A1 * 3/2005 Endo ..... F01N 3/021 60/311

(Continued)

*Primary Examiner* — Jesse S Bogue
(74) *Attorney, Agent, or Firm* — Jeremy J. Klobucar

(57) ABSTRACT

A dozer valve bracket includes a first member to secure to a rail. A second member receives a dozer valve. A pivot couples the first and second members with one another for pivotal movement with respect to one another. A stop in the second member contacts the rail to provide a second position to enable the second member to pivot away from the first member on another side of the rail to enable installation of an exhaust system.

14 Claims, 4 Drawing Sheets

(56) References Cited

U.S. PATENT DOCUMENTS

2006/0101810 A1* 5/2006 Angelo ..... F01N 3/2033
60/301
2008/0314033 A1* 12/2008 Aneja ..... F01N 3/033
60/299

* cited by examiner

HYDRACARBON DOZER VALVE PIVOTING MULTI PURPOSE BRACKET

FIELD

The present disclosure relates to passenger trucks that utilize diesel engines wherein the exhaust is required to be cleaned by fluid injection by a dozer valve.

BACKGROUND

This section provides background information related to the present disclosure which is not necessarily prior art.

In diesel engine exhaust systems, it is required to utilize fluid injection into the components by a dozer valve. The valves may be positioned out of the way so that the fluid can be monitored and injected into the exhaust system. However, the packaging of the dozer valve becomes difficult in the given vehicle envelope. Due to the exhaust components securement mechanisms, the valve cannot be positioned along a reinforcement rail due to the fact that as the exhaust component is connected with other exhaust components, the dozer valve is in the way of the installation of the exhaust components. Thus, there is a need for the dozer valves to be positioned into the packaging envelope without prohibiting or hampering installation of the exhaust components with one another.

The present disclosure provides a bracket to remove the dozer valve from the packaging envelope during installation of the exhaust components and return the dozer valve into the packaging envelope after installation of the exhaust components. The present disclosure provides a bracket that is pre-installed onto the reinforcement rail prior to the installation of the rail onto the vehicle frame. The present disclosure provides a bracket system that enables movement of the dozer valve out of the envelope to enable exhaust installation and returns the valve back into the envelope after installation.

SUMMARY

This section provides a general summary of the disclosure, and is not a comprehensive disclosure of its full scope or all of its features.

According to a first aspect of the disclosure, a dozer valve bracket comprises a first member to be secured to a reinforcement rail. A second member receives a dozer valve. A pivot couples the first and second members with one another for pivotal movement with respect to one another. A stop is in the second member to contact the rail to provide a second position to enable the second member to be pivoted away from the first member on another side of the rail to enable installation of an exhaust system. The first member includes one or more apertures to enable fasteners to secure the first member to the rail. The first member includes a body portion that secures the first member to the rail with a projecting flange to receive the pivot. The body portion includes a second projecting flange that includes a lock member to secure the first and second members together. The second member includes a wall to receive the dozer valve so that the dozer valve is positioned on the second member. The second member includes a heat shield spaced from the wall by a body portion so that the heat shield is substantially parallel to the wall. The lock includes a mechanical fastener.

According to a second aspect of the disclosure, a vehicle frame includes a dozer valve bracket secured with a reinforcement rail. The dozer valve bracket comprises a first member to be secured to the reinforcement rail. A second member receives a dozer valve. A pivot couples the first and second members with one another for pivotal movement with respect to one another. A stop is in the second member to contact the rail to provide a second position to enable the second member to be pivoted away from the first member on another side of the rail to enable installation of an exhaust system. The first member includes one or more apertures to enable fasteners to secure the first member to the rail. The first member includes a body portion that secures the first member to the rail with a projecting flange to receive the pivot. The body portion includes a second projecting flange that includes a lock member to secure the first and second members together. The second member includes a wall to receive the dozer valve so that the dozer valve is positioned on the second member. The second member includes a heat shield spaced from the wall by a body portion so that the heat shield is substantially parallel to the wall. The lock includes a mechanical fastener.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
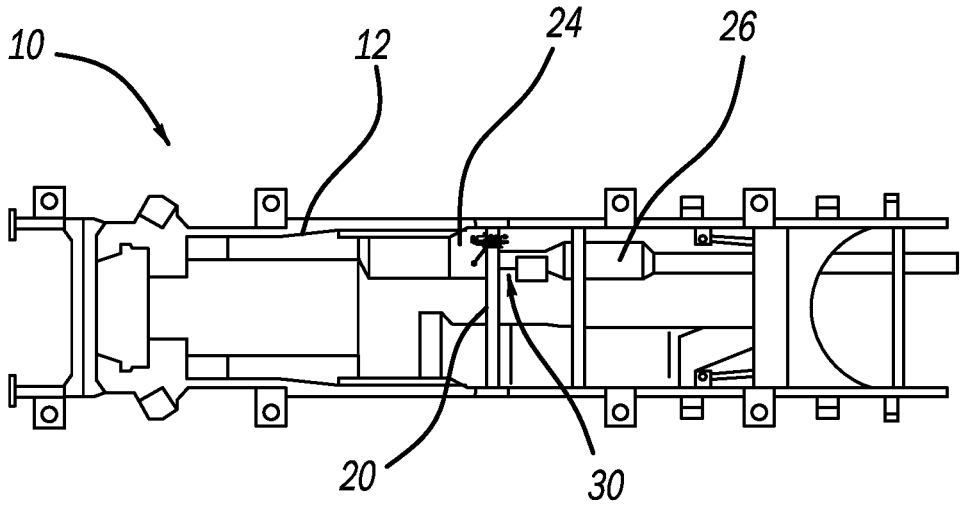
FIG. 1 is a schematic view of a vehicle frame.

Example embodiments will now be described more fully with reference to the accompanying drawings.

Turning to the figures, a vehicle frame is illustrated and designated with the reference numeral 10. The frame 10 generally includes side beams 12, 14 as well as cross-rails 20. The exhaust system 22 is illustrated with a first section 24 and a second section 26. The second section 26 is bolted or the like with the first section 24 when it is on the frame 10. The second section 26 is moved in a colinear direction onto the first section 24. A dozer valve assembly bracket 30 is illustrated on the cross-rail 20. The bracket 30 is secured to the rail by fasteners or the like. Also, the rail 20 includes a flange securing it to the side beam 12.

The bracket 30 includes a first member 32 and a second member 34. The first member 32 and second member 34 are coupled with one another via pivot 36. The first member 32 includes a body 38 with apertures 40 to receive fasteners 42 that secure the first member 32 to the rail 20. The body 38 includes step portions 44, 46 that extend laterally along the rail 20. A flange 48 extends from the step portion 46 and a flange 50 extends from the step portion 44. The flange 48 includes an aperture to receive the pivot 36. Generally, the flange 48 is positioned below the rail 20. The flange 50 includes a lock member 52, such as a fastener, that secures the first member 32 with the second member 34 locking them together in a first position after the exhaust sections 24, 26 have been secured with one another.

The second member 34 includes a body portion 60. The body portion 60 includes a wall 62, to secure the dozer valve 64, a pair of legs 66, 68 that enable the second member to be locked with the first member and also to pivot with respect to the first member 32, respectively. The legs are L-shaped and have apertures to receive the lock fastener as well as the pivot pin 36. The leg 68 includes a stop 70. The stop 70 could be a notch or the like that is positioned adjacent the body of the rail 20 to enable the second member to be stopped in a position removed from the packaging envelope to enable installation of the exhaust sections 24, 26. The body 60 includes an extending member 72 that includes a projecting heat shield 74. The heat shield 74 is spaced from the wall 62 so that the second member 34 has an overall U-shape. Thus, the valve 64 is positioned between the wall 62 and the heat shield 74. The heat shield 74 is substantially parallel to the wall 62. The wall 62 includes apertures 76 to receive fasteners to secure the valve 64 onto the wall 62. The apertures are positioned to receive the fastener such that the valve output and the valve input is on a 15° angle above horizontal so that proper fuel passage is accomplished through the valve 64 via the flex line 78 coupled with the fuel tank.

Figure 2:
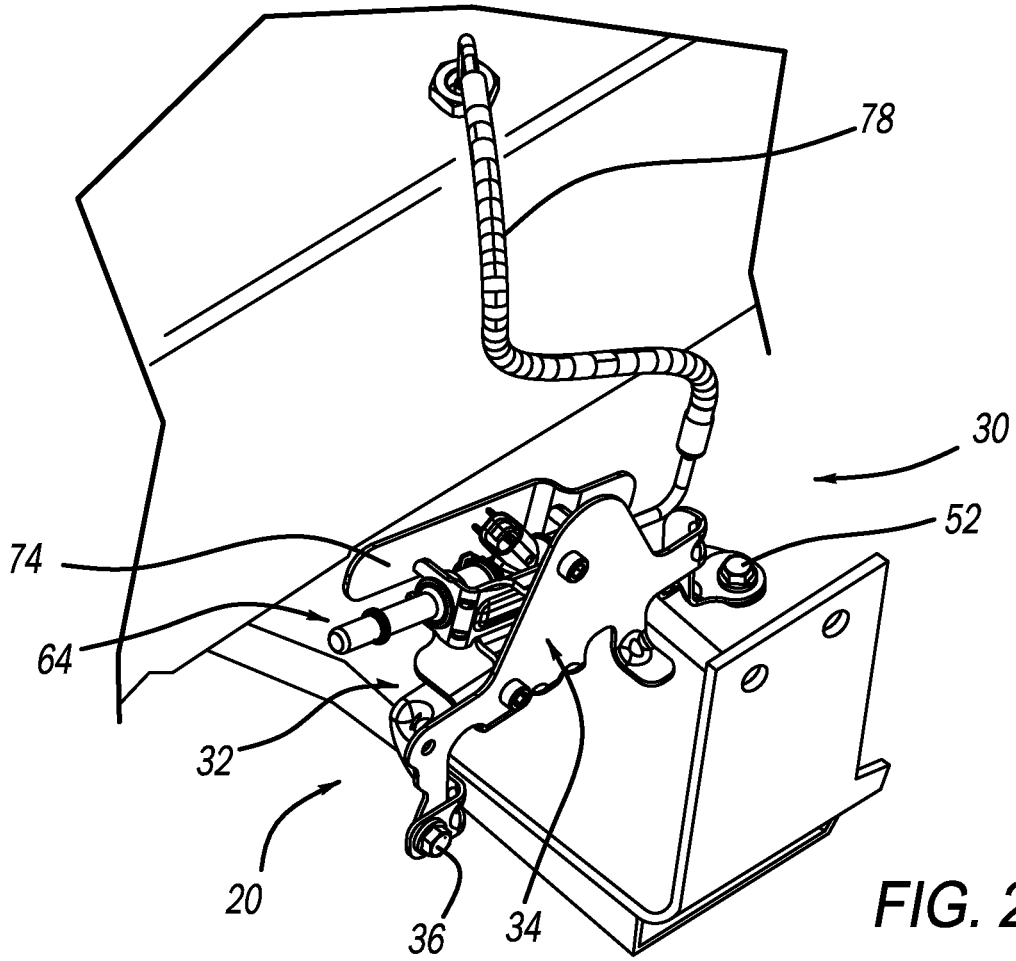
FIG. 2 is a perspective view of the bracket system on a rail in a first position.
Figure 3:
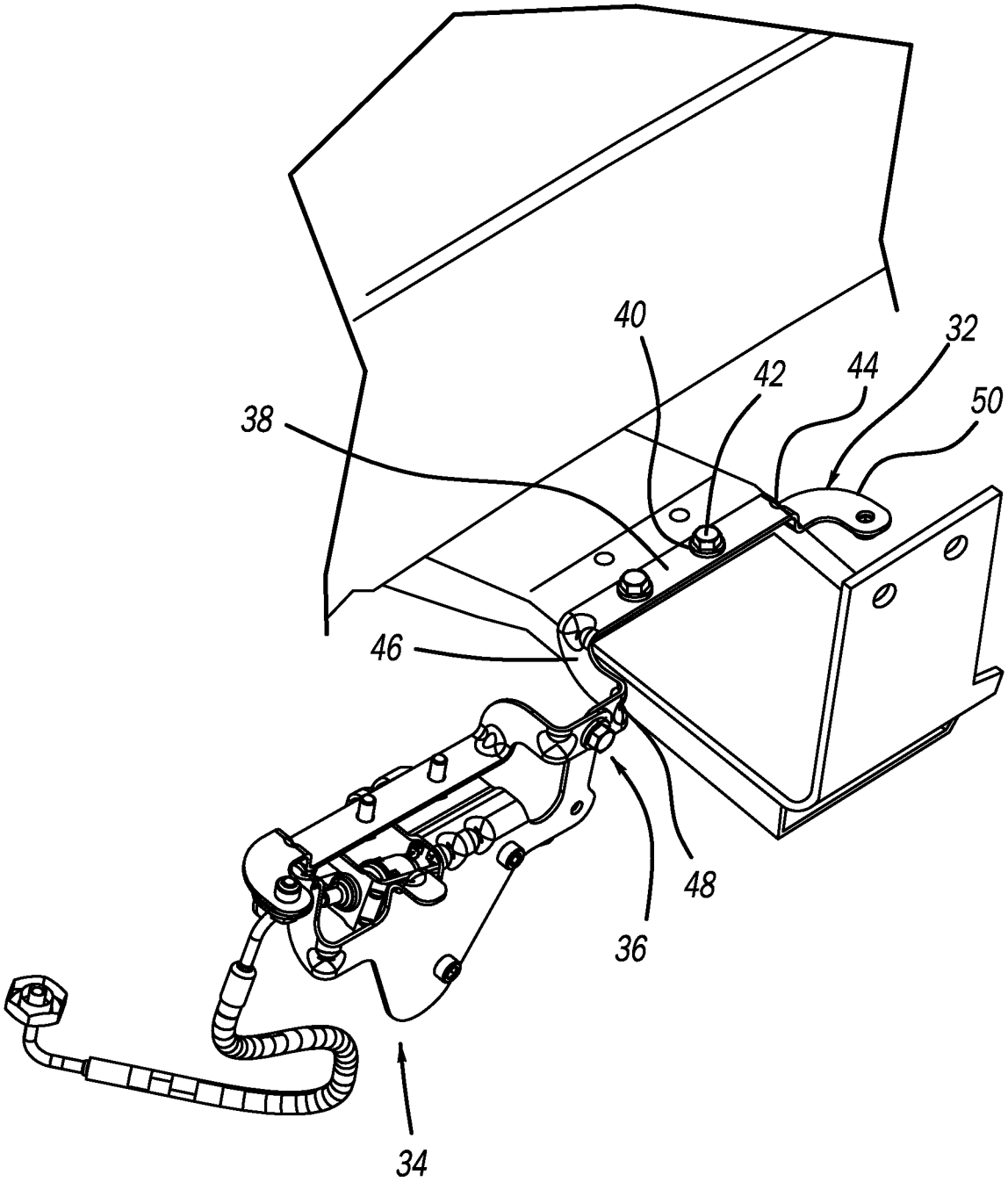
FIG. 3 is a view like FIG. 2 with the rail in a second position.
Figure 4:
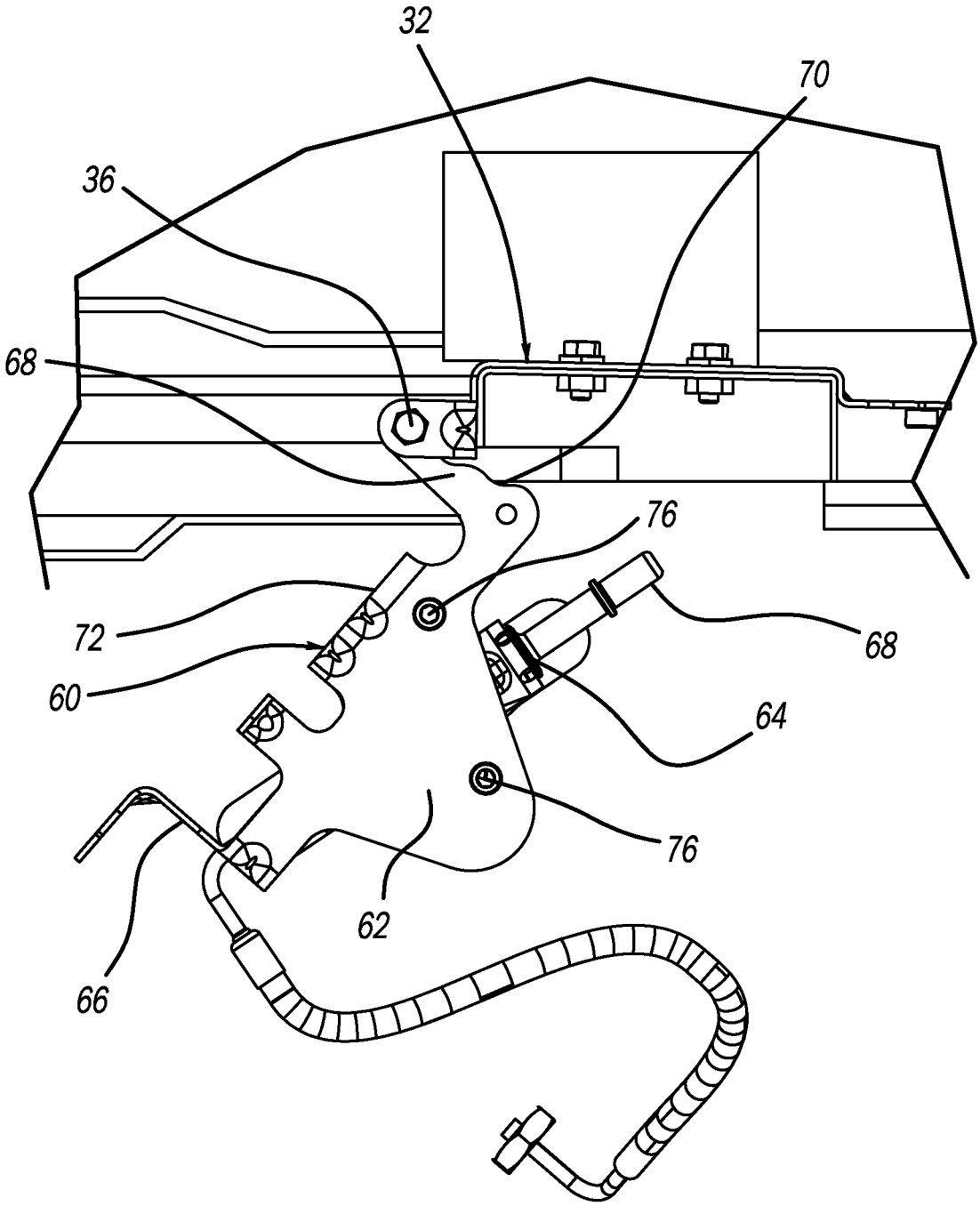
FIG. 4 is a front plan view of the bracket of FIG. 3.
Figure 5:
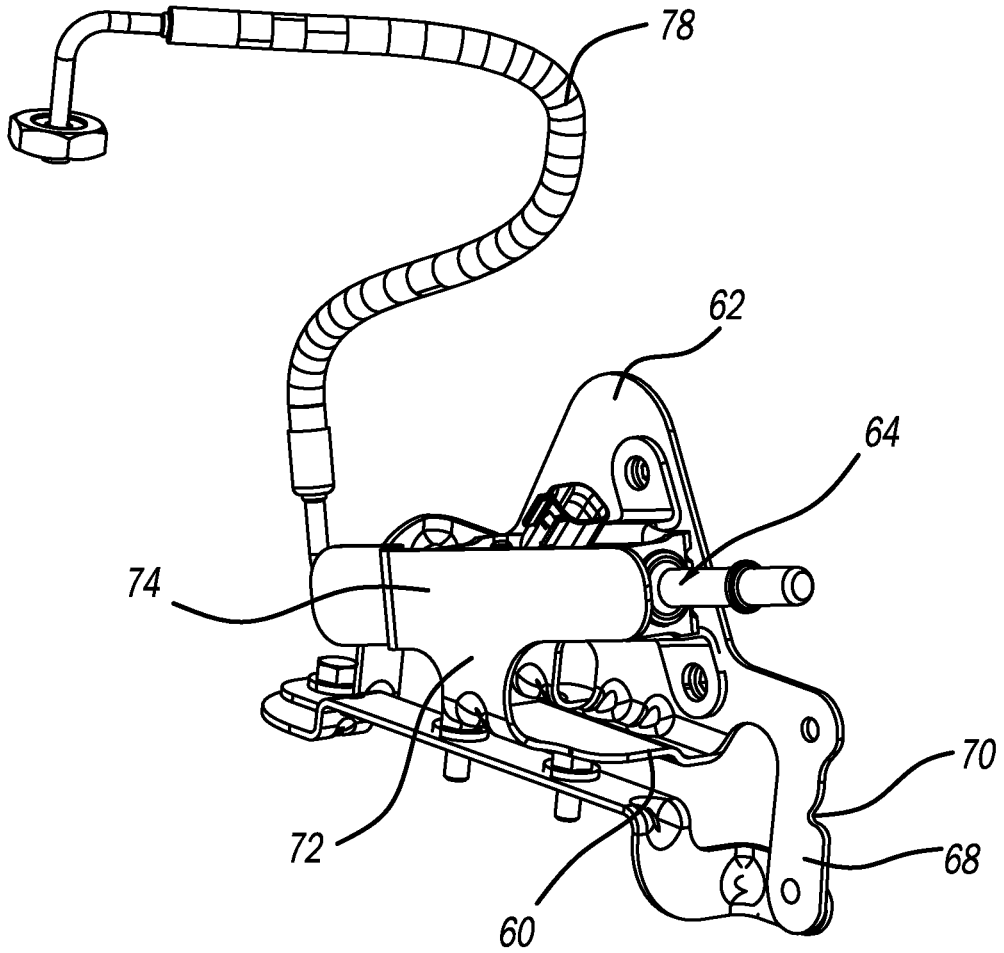
FIG. 5 is a perspective view of the bracket.

The bracket 30 is secured to the rail 20 prior to rail 20 being secured with the side beam 12. The bracket 30 and dozer valve 64 therefore are secured with the side beam 12 prior to the addition of the exhaust system 22. The fastener lock is removed to enable the second member 34 to pivot with respect to the first member 32. The second member 34 is pivoted into the position illustrated in FIG. 4. At this point in time, the exhaust sections 24, 26 are connected with one another axially on a line with no obstruction or interference from the dozer valve. After the exhaust sections or components 24, 26 are combined together, the second member 34 is flipped or pivoted to its first position where the fastener 52 connects and locks the first member 32 to the second member 34 as illustrated in FIG. 2. Thus, the exhaust components 24, 26 can be combined with one another while the dozer valve 64 is out of the packaging envelope and then the dozer valve 64 can easily be brought back into the packaging envelope and secured with the cross rail 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A dozer valve bracket comprising:

a first member for securing to a rail;

a second member for receiving a dozer valve, and a pivot coupling the first and second members with one another for pivotal movement with respect to one another;

a stop in the second member for contacting the rail for providing a second position enabling the second member to pivot away from the first member on another side of the rail to enable installation of an exhaust system.

2. The dozer valve bracket of claim 1, wherein the first member includes one or more apertures for enabling fasteners to secure the first member with the rail.

3. The dozer valve bracket of claim 1, wherein said first member includes a body portion for securing to the rail and a first projecting flange for receiving the pivot.

4. The dozer valve bracket of claim 3, wherein said body portion includes a second projecting flange including a lock for securing the first member with the second member.

5. The dozer valve bracket of claim 1, wherein the second member includes a wall for receiving the dozer valve and the wall position the dozer valve on the second member.

6. The dozer valve bracket of claim 5, wherein the second member includes a heat shield spaced from the wall by a body portion and the heat shield substantially parallel to the wall.

7. The dozer valve bracket of claim 4, wherein the lock includes a mechanical fastener.

8. A dozer valve and bracket on a frame assembly comprising:

a dozer valve;

a first member for securing to a rail of the frame;

a second member for receiving a dozer valve, and a pivot coupling the first and second members with one another for pivotal movement with respect to one another;

a stop in the second member for contacting the rail for providing a second position enabling the second member to pivot away from the first member on another side of the rail to enable installation of an exhaust system.

9. The dozer valve and bracket of claim 8, wherein the first member includes one or more apertures for enabling fasteners to secure the first member with the rail.

10. The dozer valve and bracket of claim 8, wherein said first member includes a body portion for securing to the rail and a first projecting flange for receiving the pivot.

11. The dozer valve and bracket of claim 10, wherein said body portion includes a second projecting flange including a lock for securing the first member with the second member.

12. The dozer valve and bracket of claim 8, wherein the second member includes a wall for receiving the dozer valve and the wall position the dozer valve on the second member.

13. The dozer valve and bracket of claim 12, wherein the second member includes a heat shield spaced from the wall by a body portion and the heat shield substantially parallel to the wall.

14. The dozer valve and bracket of claim 11, wherein the lock includes a mechanical fastener.

* * * * *